United States Patent [19]

Fleak et al.

[11] Patent Number: 4,875,877

[45] Date of Patent: Oct. 24, 1989

[54] DISCRETE CABLE ASSEMBLY

[75] Inventors: David S. Fleak, Palmyra; Keith S. Koegel, Harrisburg; William B. Long, Camp Hill; Stanford C. Moist, Jr., Hummelstown; Warren D. Nauman, Elizabethtown, all of Pa.

[73] Assignee: AMP Incorporated, Harrisburg, Pa.

[21] Appl. No.: 243,385

[22] Filed: Sep. 12, 1988

[51] Int. Cl.[4] ..... H01R 9/07

[52] U.S. Cl. ..... 439/497; 439/108; 439/516; 439/885

[58] Field of Search ..... 439/885, 512, 513, 516, 439/92–99, 108, 492–499, 874, 736, 696, 701; 29/884

[56] References Cited

U.S. PATENT DOCUMENTS

| | | | |
|---|---|---|---|
| 3,611,270 | 10/1971 | Eppler | 439/701 |
| 4,083,615 | 4/1978 | Volinskie . | |
| 4,310,208 | 1/1982 | Webster et al. . | |
| 4,379,361 | 4/1983 | Webster et al. . | |
| 4,464,003 | 8/1984 | Goodman et al. | 439/92 |
| 4,484,792 | 11/1984 | Tergler et al. . | |
| 4,579,404 | 4/1986 | Lockard . | |
| 4,586,769 | 5/1986 | Tengler et al. . | |
| 4,592,606 | 6/1986 | Mudra | 439/516 |
| 4,602,830 | 7/1986 | Lockard . | |
| 4,602,831 | 2/2986 | Lockard . | |
| 4,649,636 | 3/1987 | Arbogast, Jr. et al. . | |
| 4,655,515 | 4/1987 | Hansher et al. . | |
| 4,682,840 | 2/1987 | Lockard . | |
| 4,750,266 | 6/1988 | Brandeau | 29/884 |
| 4,767,357 | 8/1988 | Hasircoglu | 439/499 |
| 4,775,333 | 10/1988 | Grider et al. | 439/736 |
| 4,781,620 | 11/1988 | Tengler et al. | 439/497 |

FOREIGN PATENT DOCUMENTS

| | | |
|---|---|---|
| 0112019 | 6/1984 | European Pat. Off. . |
| 0211496 | 2/1987 | European Pat. Off. . |

*Primary Examiner*—David Pirlot

*Attorney, Agent, or Firm*—Gerald K. Kita

[57] ABSTRACT

An electrical connector assembly for connection to an electrical cable comprises; an insulative housing block, conductive signal contacts on the housing block, a ground bus on the housing block connected to at least one selected signal contact, wire connecting portions of the signal contacts appear at corresponding first openings formed in the housing block, wire connecting portions of the ground bus appear at corresponding second openings of the housing block, and the housing block is formed to surround and insulate each of the signal contacts to allow insertion of the signal contacts into an insulative housing.

18 Claims, 13 Drawing Sheets

1
2
3
4
5
9
10
16
22
23
24
34
35
36

DISCRETE CABLE ASSEMBLY

FIELD OF THE INVENTION

The specification discloses a method for terminating multiple electrical wires with conductive electrical contacts of an electrical connector assembly.

BACKGROUND OF THE INVENTION

A known electrical connector assembly is disclosed in U.S. Pat. No. 4,655,515 and comprises, an insulative housing block, conductive signal contacts on the housing block having wire connecting portions for connection to corresponding signal wires of an electrical cable, a ground bus on the housing block having wire connecting portions for connection to corresponding ground wires of the cable, and means for connecting the ground bus and at least one selected signal contact. According to the known connector assembly, the signal wires are routed to corresponding signal contacts along one side of the housing block. The ground wires are routed to a second side of the housing block for connection to corresponding ground contacts.

SUMMARY OF THE INVENTION

According to the invention, an electrical connector assembly is provided wherein, the wire connecting portions of the signal contacts appear at corresponding first openings of the housing block, the wire connecting portions of the ground bus appear at corresponding second openings of the housing block, and each of the signal contacts is insulated by the housing block to allow stacking of the signal contacts with other similar signal contacts insulated by a second housing block, whereby the first recited housing block and the second housing block combine to form a unitary electrical connector assembly.

In the known connector assembly, stacking of two rows of signal contacts is impracticable until an overmolding of insulative material covers and adheres to the signal contacts, the housing block and the ground bus.

Further according to the invention, the first openings and the second openings are encircled by the housing block for isolation one from the other. Isolation of the openings one from the other is particularly advantageous to prevent electrical shorting of wire connections formed by welding or soldering in the openings. Often the openings are close together to achieve closely spaced wire connections, or to provide solder stop offs to limit spreading of solder that forms the wire connections.

In the known connector, wire connections to the ground bus on one side of the housing block are not isolated one from one another, and are isolated from the signal wires by routing the signal wires to a different side of the housing block.

Further according to the invention, each of the first and second openings extends through opposite sides of the housing block to receive an opposed pair of welding electrodes for clamping therebetween a corresponding wire and a corresponding wire connecting portion.

Further according to the invention, wire gripping portions of the housing block are provided for gripping corresponding wires of an electrical cable and for positioning the wires along corresponding wire connecting portions.

In the known connector assembly, each electrical contact has a clamp for gripping a corresponding wire.

The clamp is joined to the wire by welding. The clamp has a construction suited for laser welding. The construction of the clamp prevents clamping of the wire and a corresponding wire connecting portion between an opposed pair of welding electrodes of a conventional welding apparatus. Instead, welding is accomplished by a laser, an unconventional, and thereby more costly apparatus.

In the known connector assembly, slots in the housing block hold corresponding wires near the clamps of the contacts The slots are not relied upon for positioning corresponding wires along the contacts for welding. Instead, the clamps that become joined to the wires by welding are relied upon to position the wires along the contacts for welding.

Further according to the invention, in the housing block, each of multiple wire receiving channels divides into a first channel portion communicating with a corresponding first opening and a second channel portion communicating with a corresponding second opening, thereby to separate a signal wire extending along the first channel portion from a ground wire extending along the second channel portion.

According to the known connector, each channel does not divide to separate a signal wire from a ground wire.

Further according to the invention, corresponding third openings extend through the housing block, each corresponding third opening is located between a corresponding wire connecting portion of the ground bus and a corresponding signal contact to provide a solder stop off.

Further according to the invention, severable portions of the signal contacts appear at corresponding third openings, each of the contacts is constructed for being detached from the ground bus by severing, whereby selected signal contacts are detached from the ground bus and at least one or more other selected signal contacts remain joined to the ground bus.

Further according to the invention, the housing block has a thin construction for stacking together multiple such housing blocks to provide closely spaced rows of contacts in a connector assembly.

Further according to the invention, the ground bus extends outwardly from the housing block, and when multiple housing blocks are stacked together to provide closely spaced rows of contacts, each corresponding ground buss is stacked with each other ground bus for connection electrically in common, or for connection to a massive ground bus for lowering current density.

The invention will be described by way of example in a following detailed description with reference to the accompanying drawings.

Figure 1:
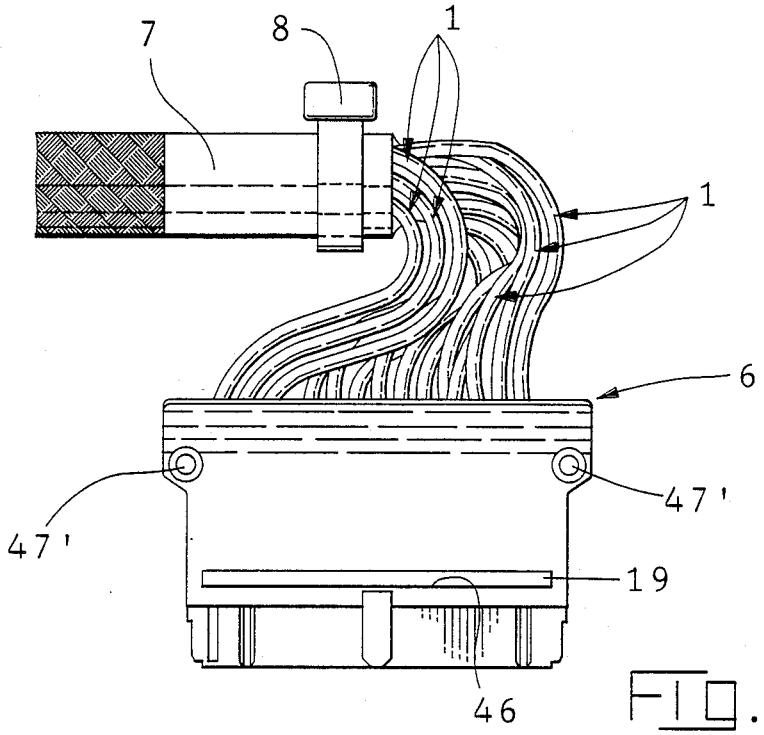
FIG. 1 is a fragmentary perspective view of a composite electrical connector assembly connected to discrete electrical cables.

A discrete cable 1 is described with reference to FIG. 4, and is constructed with an elongated signal wire 2 or center conductor concentrically encircled by a dielectric 3, in turn, encircled by a flexible and insulative, outer jacket 4 or sheath. An elongated and conductive ground wire 5 or drain wire extends along the exterior of the dielectric 3 and is within the jacket 4 or sheath. The cable construction is cut to expose the signal wire 2, the dielectric 3 and the ground wire 5 from the jacket 4 as shown in FIG. 4.

Figure 2:
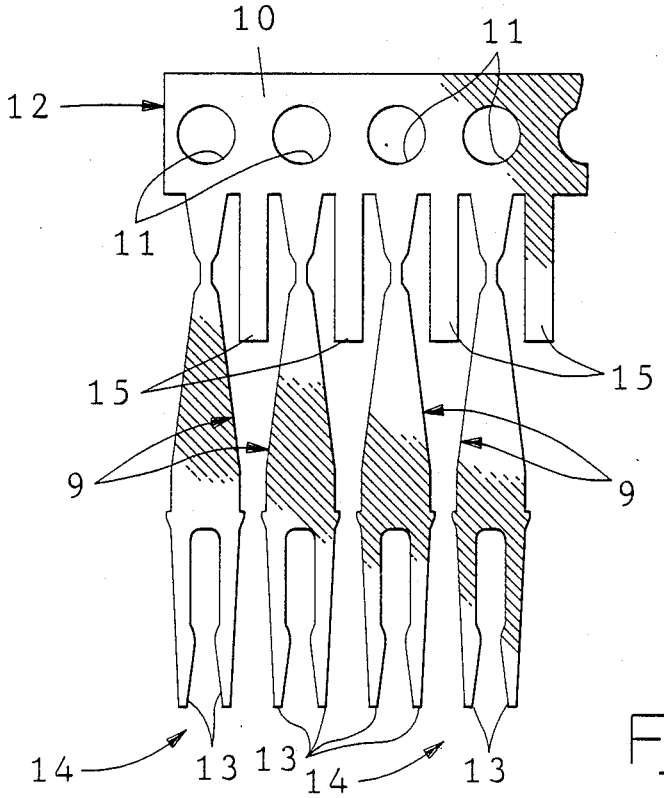
FIG. 2 is a plan view of a portion of a ground bus joined to signal contacts in a lead frame construction.

With reference to FIG. 1, an electrical connector assembly 6 is connected to multiple discrete cables 1. The multiple cables 1 are encircled by a sheath 7 and are further gathered into a bundle and encircled by a bundle tie 8. The tie 8 is usually secured to a plate, not shown, that provides strain relief to the cables 1 where they project from the sheath 7. With reference to FIG. 2, multiple signal contacts 9 in a row project forwardly from an elongated ground bus 10. The contacts 9 and the ground bus 10 are cut out from a flat strip of metal by known stamping machinery, not shown. The ground bus 10 is provided along its length with a series of spaced apart pilot holes 11, which are customary and used in a known manner to advance the strip of metal along the stamping machinery. The signal contacts 9 remain joined to the ground bus 10 and provide a lead frame 12, known as an array of conductive paths for conducting electricity, with the paths joined together and cut out from a strip of metal. Each of the signal contacts 9 includes a pair of spaced apart fingers 13 defining an electrical receptacle 14 at a front end. The ground bus 10 includes elongated portions 15 corresponding in number to the number of signal contacts 9. An elongated portion 15 is between each pair of the signal contacts 9.

Figure 3:
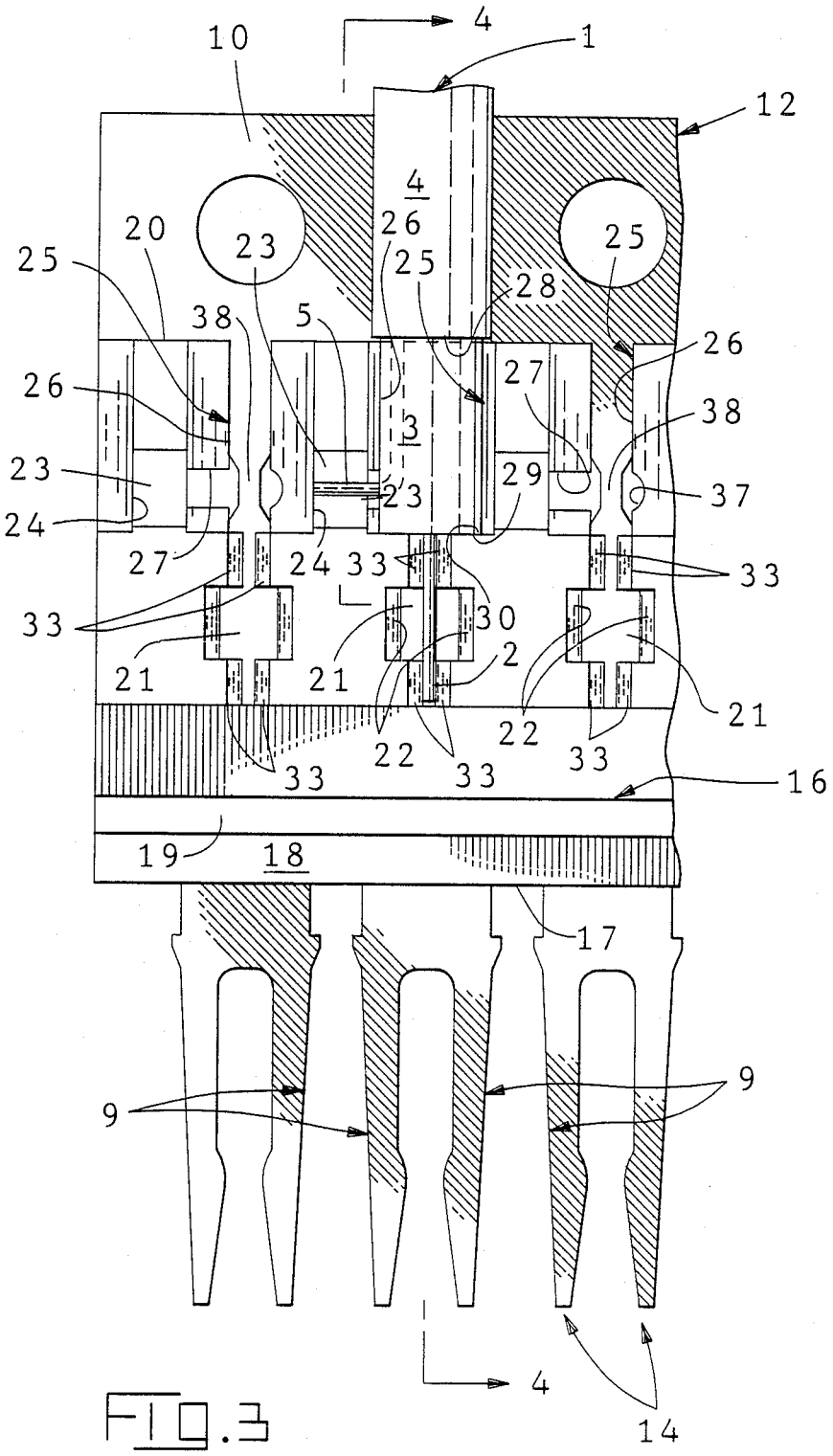
FIGS. 3 is a plan view of a portion of an electrical connector assembly, illustrating the lead frame shown in FIG. 2 and a housing block, with a portion of one electrical cable.
Figures 4, 4A:
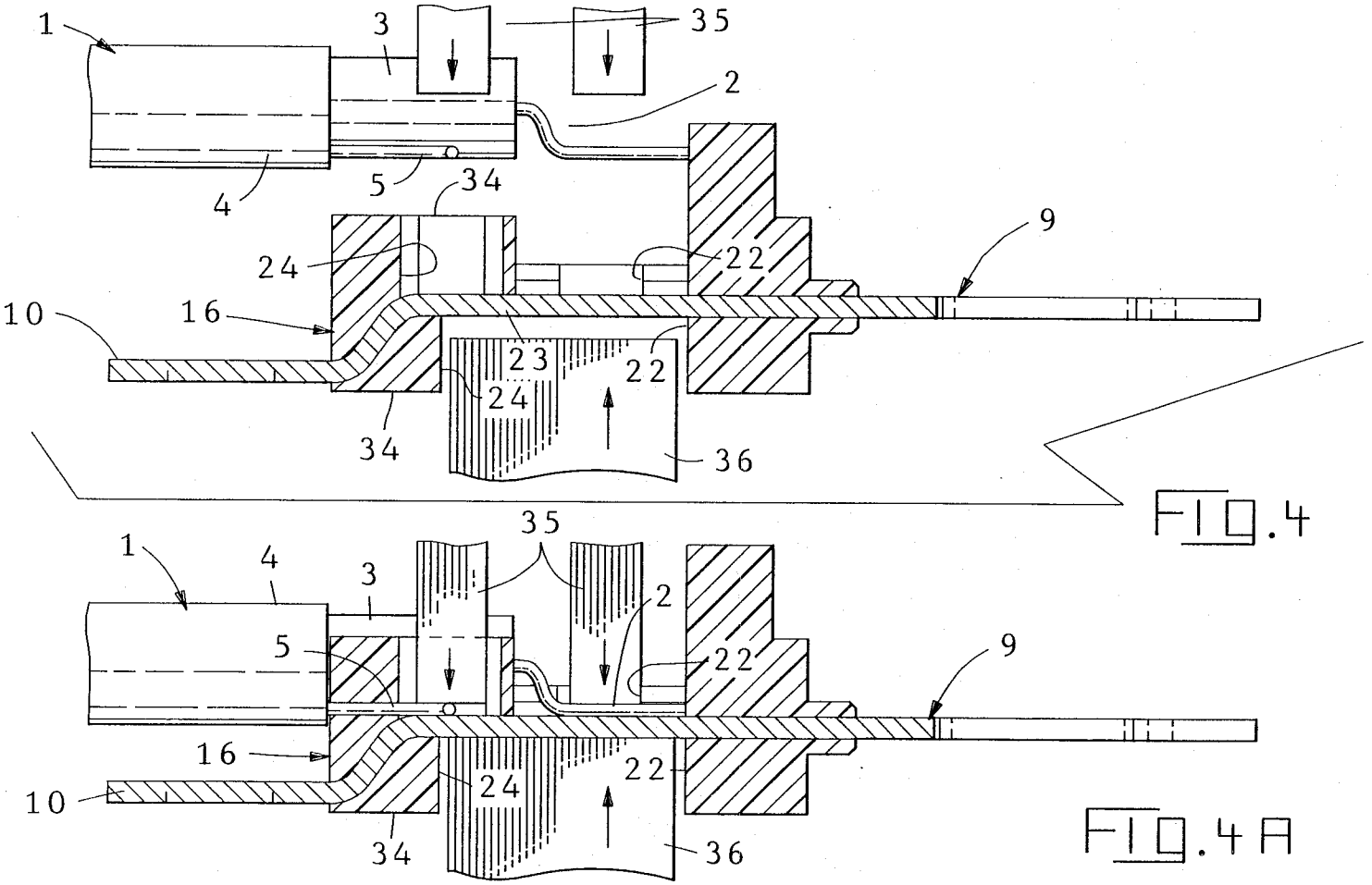
FIGS. 4 and 4A are views in section along the line 4—4 of FIG. 3, and further illustrate welding electrodes.

With reference to FIGS. 3 and 4, the lead frame 12 is on an insulative and unitary housing block 16 formed by injection molding fluent and solidifiable plastics material that imbeds the contacts 9 and the portions 15 of the ground bus 10. A front end 17 of the housing block 16 is formed with a straight front wall 18 extending transverse to the row of contacts 9 and imbedding the contacts 9 to the rear of the receptacles 14. The wall 18 projects forwardly of a front wall 19 that extends transverse to the axis of each contact 9. The housing block 16 extends rearward of the front wall 19 to a rear wall 20 from which the ground bus 10 projects. Wire connecting portions 21 of the contacts 9 appear at corresponding, spaced apart, first openings 22 formed by molding the housing block 16. Wire connecting portions 23 of the ground bus 10 appear at corresponding, spaced apart, second openings 24 formed by molding the housing block 16. Wire receiving channels 25 formed by molding the housing block 16 extend from the rear wall 20 and forwardly and axially of corresponding contacts 9.

With reference to FIG. 3, each channel 25 divides into a first channel portion 26 communicating with a corresponding first opening 22, and a second channel portion 27 communicating with a corresponding second opening 24, thereby to separate a signal wire 2 extending along the first channel portion 26 from a ground wire 5 extending along the second channel portion 27. Each channel 25 receives a portion of a corresponding cable 2 such that an end 28 of the jacket 4 engages against the rear wall 20 of the housing block 16, the dielectric 3 and the signal wire 27 and the ground wire 5 extend along the channel 25, a front end 29 of the dielectric 3 engages against a rear facing wall 30, the signal wire 2 extends from the channel 25 and along the first channel portion 25 to the wire connecting portion 23 of a corresponding signal contact 9, and the ground wire 5 extends from the first channel portion 26 and along the second channel portion 27 to the wire connecting portion 23 of the ground bus 10.

Figure 5:
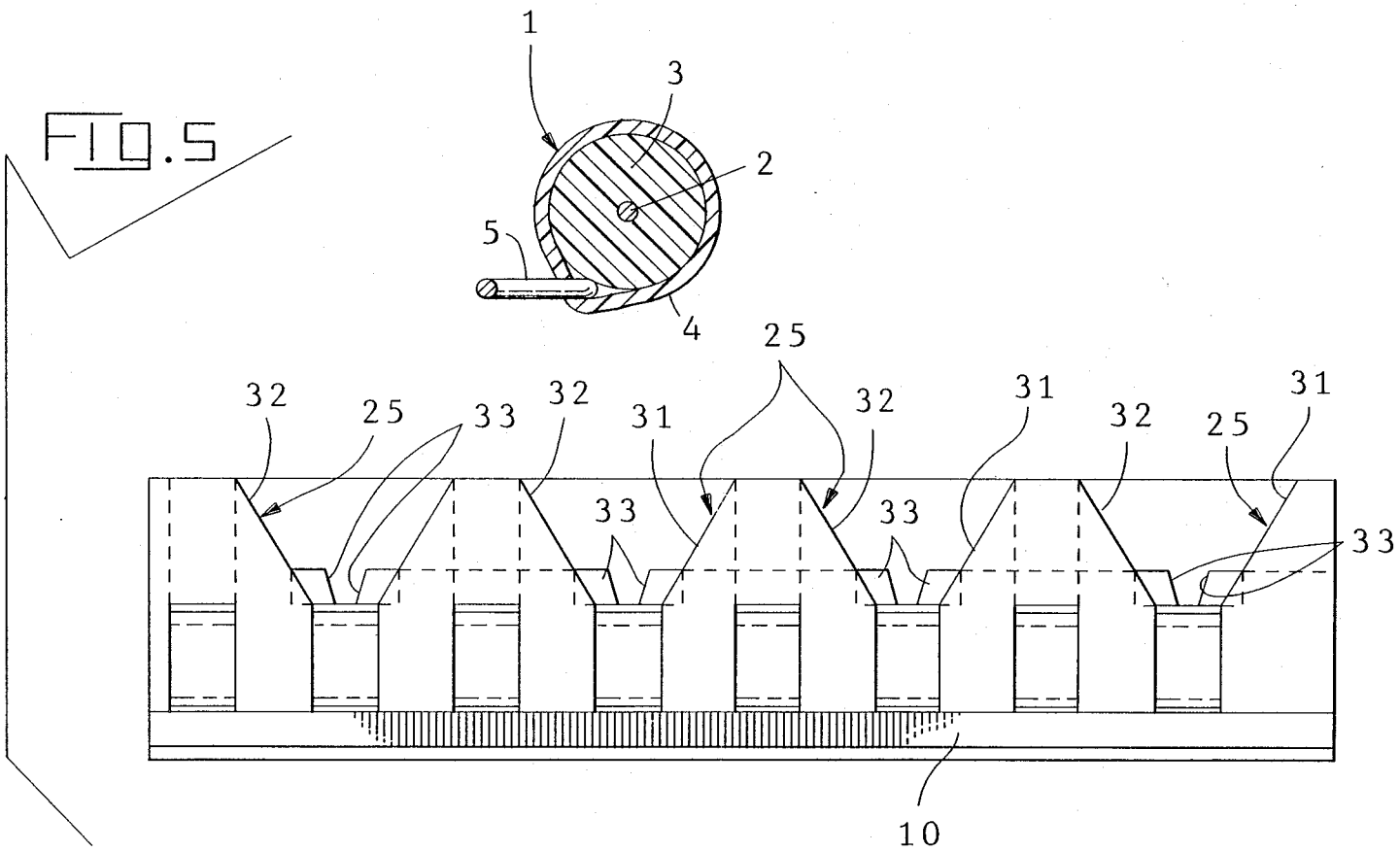
FIG. 5 is a rear elevation view of the lead frame, housing block and the cable shown in FIG. 2.

With reference to FIG. 5, each channel 25 has converging tapered sides 31,32 for engaging and guiding the dielectric 3 along the channel 25. Each first channel portion 26 has converging tapered sides 33 defining wire gripping portions adjacent to and on opposite sides of a corresponding first opening 22 for gripping the signal wire 2 and for positioning the signal wire 2 along a corresponding wire connecting portion 23 of a signal contact 9 during formation of a wire connection to be described subsequently.

As depicted in FIG. 4, each of the first openings 22 and each of the second openings 24 extends through the thickness of the housing block 16 between opposite sides 34,34 of the housing block 16 to receive an opposed pair of welding electrodes 35,36 for clamping therebetween a corresponding wire 2 or 5 and a corresponding wire connecting portion 21 or 23, during formation of a wire Connection between a corresponding wire 2 or 3 and a corresponding wire connecting portion 21 or 23.

For example, each pair of opposed electrodes is part of a known, resistance welding machine, not shown. A resistance welding machine is described in Japanese patent application Ser. No. 286438/1987, filed Nov. 12, 1987. A welding operation is accomplished as follows. The electrodes 35,36 move toward each other, enter a corresponding first opening 22 from the opposite sides 34,34 of the housing block, and clamp therebetween a corresponding wire connecting portion 21 of a signal contact 9 and a corresponding signal wire 2 which has been positioned along the wire connecting portion 21. The electrodes 35,36 form a wire connection of the signal wire 2 to the wire connecting portion 21 by resistance welding. The electrodes 35,36 are withdrawn and are moved into alignment with another opening 22. The welding operation is repeated until each signal contact 9 is connected with a signal wire 2 of a corresponding cable 1.

A pair of electrodes 35,36 is used to enter a corresponding second opening 24 from the opposite sides 34,34 of the housing block 16, and clamp therebetween a corresponding wire connecting portion 23 of the ground bus 10 and a corresponding ground wire 5 which has been positioned along the wire connecting portion 23, and to form a wire connection, and to withdraw and move into alignment with another second opening 24. The welding operation is repeated until each wire connecting portion 23 is connected with a ground wire 5 of a corresponding cable 1. The first openings 22 are spaced apart equally, and the second openings 24 are spaced apart equally, for permitting indexed movement of the electrodes 35,36 to each opening. Each of the first openings 22 and each of the second openings 24 are encircled by the housing block 16 for isolation one from the other during formation in the openings 22,24 of wire connections of corresponding wires 2,5 with corresponding wire connection portions 21,23.

The wire connection of each signal wire 2 and the wire connection of each ground wire 5 can be formed by a known soldering operation. Thereby the housing block 16 provides a solder stop off encircling each opening 22,24 to limit spreading of molten solder. In addition, the housing block 16 is formed with third openings 37, FIG. 3, formed to extend from the first side 34 to the second side 34. Each third opening 37 is located between a corresponding wire connecting portion 23 of the ground bus 10 and a corresponding signal contact 9 to provide a solder stop off that limits the spread of molten solder between the ground bus 10 and the corresponding contact 9.

Each signal contact 9 is constructed for being detached from the ground bus 10. With reference to FIG. 3, a narrow portion 38 of each contact 9 appears at a corresponding third opening 37.

Figure 3A:
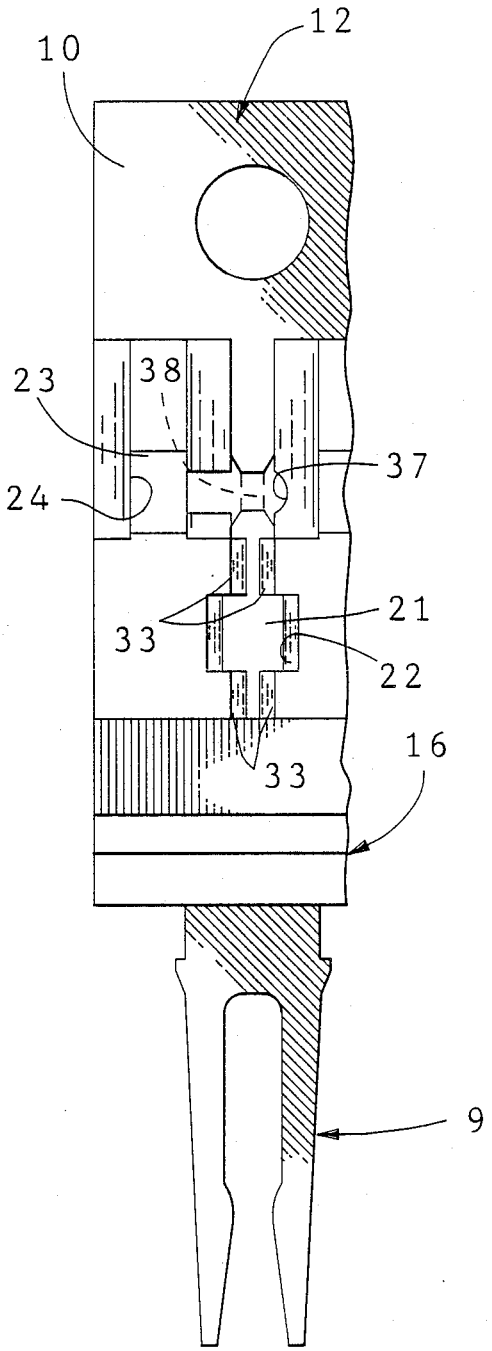
FIG. 3A is a view similar to FIG. 3, illustrating a signal contact detached from a ground bus.

With reference to FIG. 3A, a corresponding contact 9 is disclosed with its corresponding narrow portion 38 removed. Each narrow portion 38 is a removable portion that is severed to remove the same. Each third opening 37 extends from the first side 34 of the housing block 16 to the second side 34 to allow a punch, not shown, to enter the opening 37 and sever the corresponding narrow portion 38. Each signal contact 9 is detached by severing a corresponding narrow portion 38, whereby selected signal contacts 9 are detached from the ground bus 10 and one or more other signal contacts 9 may remain joined to the ground bus 10. When the narrow portion 38 is located along the wire receiving channel 25, the removable, narrow portion 38 is severed before the cable 1 is assembled in the channel 25.

Figure 3B:
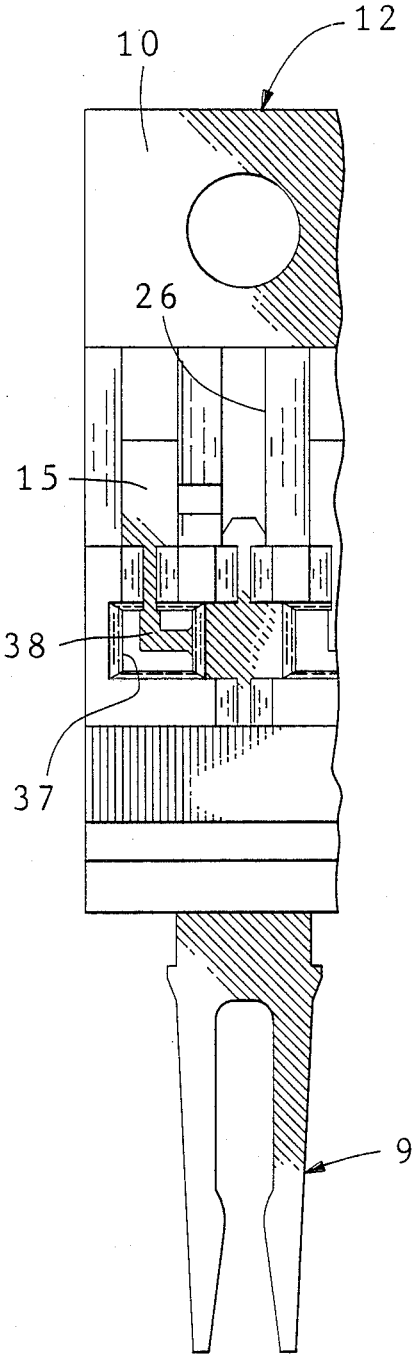
FIG. 3B is a view similar to FIG. 3 illustrating a modification of the lead frame and of the housing block.

According to FIG. 3B the lead frame 12 is modified such that the narrow portion 38 of a corresponding signal contact 9 connects to a corresponding elongated portion 15 of the ground bus 10. The third opening 37 is beside the corresponding first channel portion 26. The narrow portion 38 appearing at the third opening 37 may be severed after a signal wire 2 is assembled in the first channel portion 26.

Figure 6:
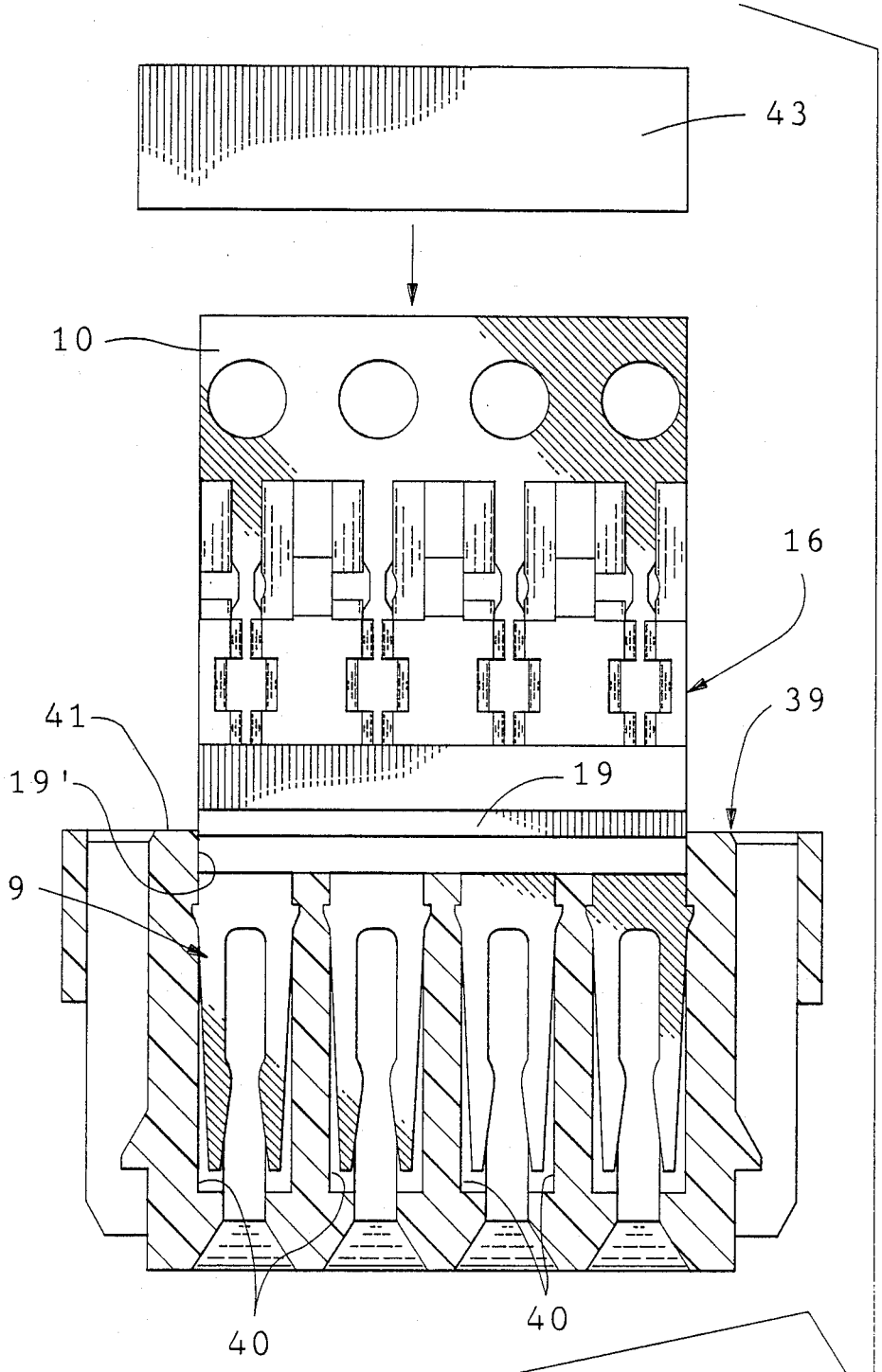
FIG. 6 is a front elevation view in section of a portion of a composite electrical connector assembly.
Figure 7:
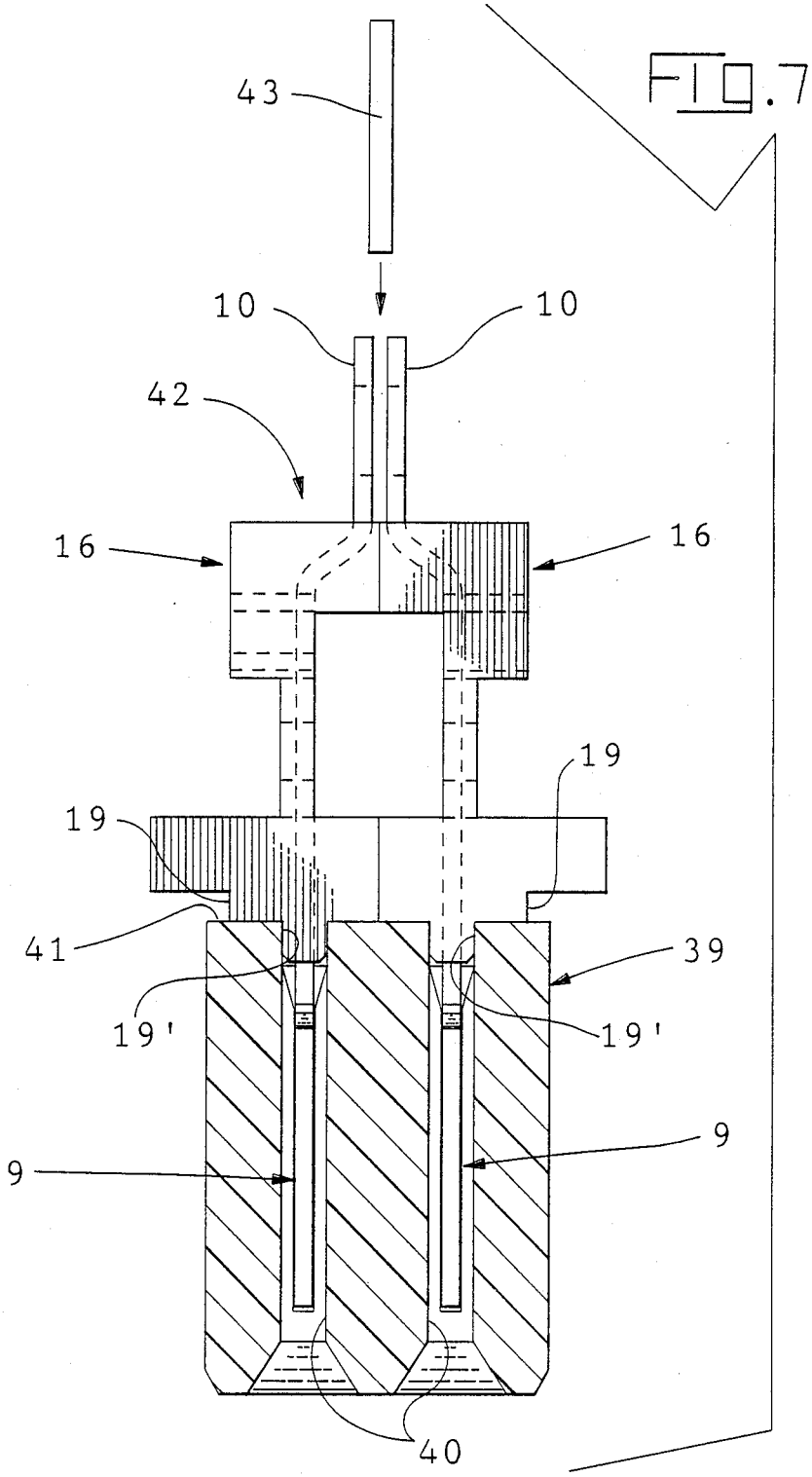
FIG. 7 is a side elevation view in section of the portion of the electrical connector assembly shown in FIG. 5.

With reference FIGS. 6 and 7, an insulative housing 39 includes two rows of spaced apart contact receiving cavities 40. The cavities 40 of each row are spaced apart on a pitch spacing corresponding to the pitch spacing of the signal contacts 9 connected to the ground bus 10. A group of first signal contacts 9 is shown fully assembled in corresponding cavities 40 of a first row, with the front rib 19 of the housing block 16 engaged on a rear 41 of the housing 39. A group of second signal contacts 9 is shown fully assembled in corresponding cavities 40 of a second row, with the front wall 19 of a corresponding housing block 16 engaged on a rear 41 of the housing 39. For illustration purposes, the signal contacts 9 are shown as being full assembled to the housing 39 without corresponding cables 2 being connected to the signal contacts 9. It should be understood that corresponding cables 1 are connected to the signal contacts 9 before the contacts 9 are fully assembled in the cavities 40.

Figure 7A:
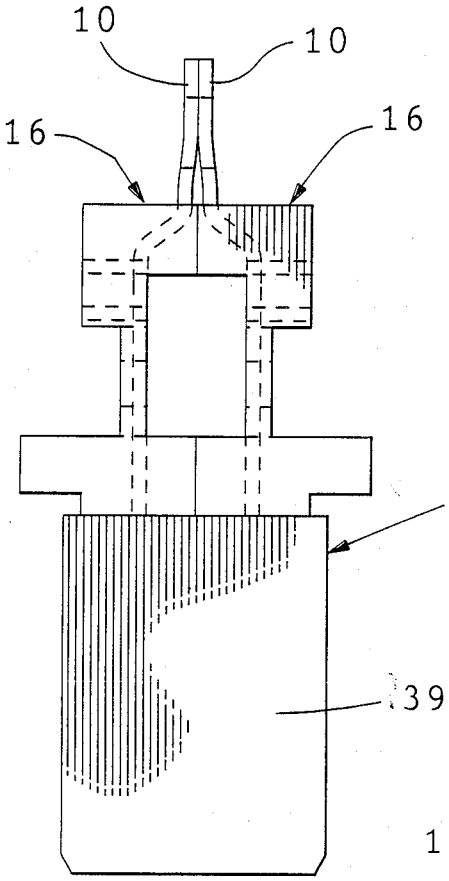
FIG. 7A is a view similar to FIG. 7 and illustrates a first ground bus and a second ground bus joined together.

A first ground bus 10 is connected to at least one first signal contact 9, and projects from the first housing block 16. A second ground bus 10 can be connected to at least one second signal contact 9 and projects from the second housing block 16. Each of the first signal contacts 9 is insulated by a first housing block 16 thereby to allow stacking of the first signal contacts 9 with the second similar signal contacts 9 insulated by a corresponding second housing block 16, whereby the first housing block 16 and the second housing block 16 combine to form a composite electrical connector assembly 12. Each ground bus 10,10 and the wire connecting portions 23 of the ground bus 10 and the corresponding signal contacts 9 are joined together as a unitary strip of metal. The strip has a thickness extending transverse to longitudinal axes of the contacts 9 and parallel to the thickness of the housing block 16. The second ground bus 10 is constructed for being joined to the first ground bus 10 in the composite electrical connector assembly 42. For example, the first ground bus 10 and second ground bus 10 are adjacent each other, and can be bent toward each other and joined together by welding, as depicted in FIG. 7A.

Figure 7B:
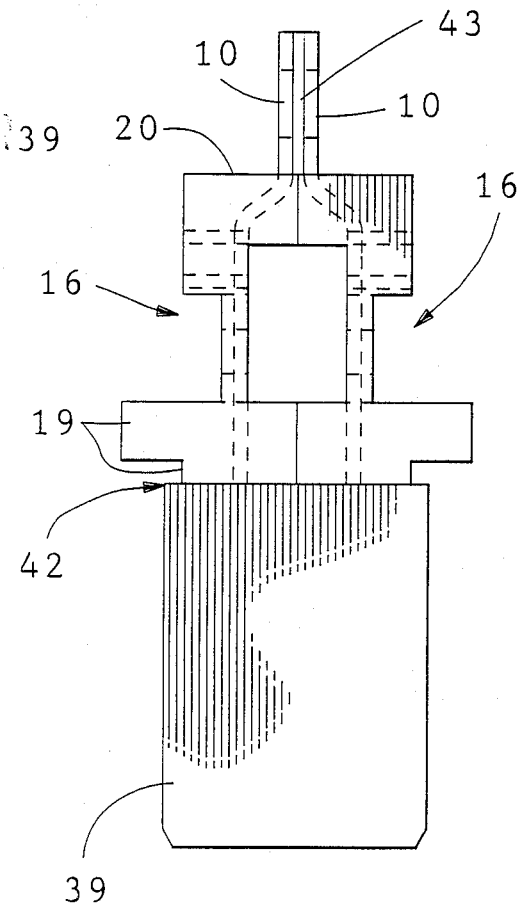
FIG. 7B is a view similar to FIG. 7 and illustrates a ground bar or alternatively an insulator joined to a first ground bus and a second ground bus.

Further a conductive ground bar 43 having a larger mass than either ground bus 10 can be inserted between the first ground bus 10 and the second ground bus 10. For example, each ground bus 10 is joined to each other and to the ground bar 43 by welding as depicted in FIG. 7B. Alternatively, each ground bus 10 is joined to the bar 43 which is an insulative bar 43 to isolate electrically one ground bus 10 from the other. Thereby, each ground bus 10 has its own electrical potential, and two separate ground potentials are provided.

Figure 8:
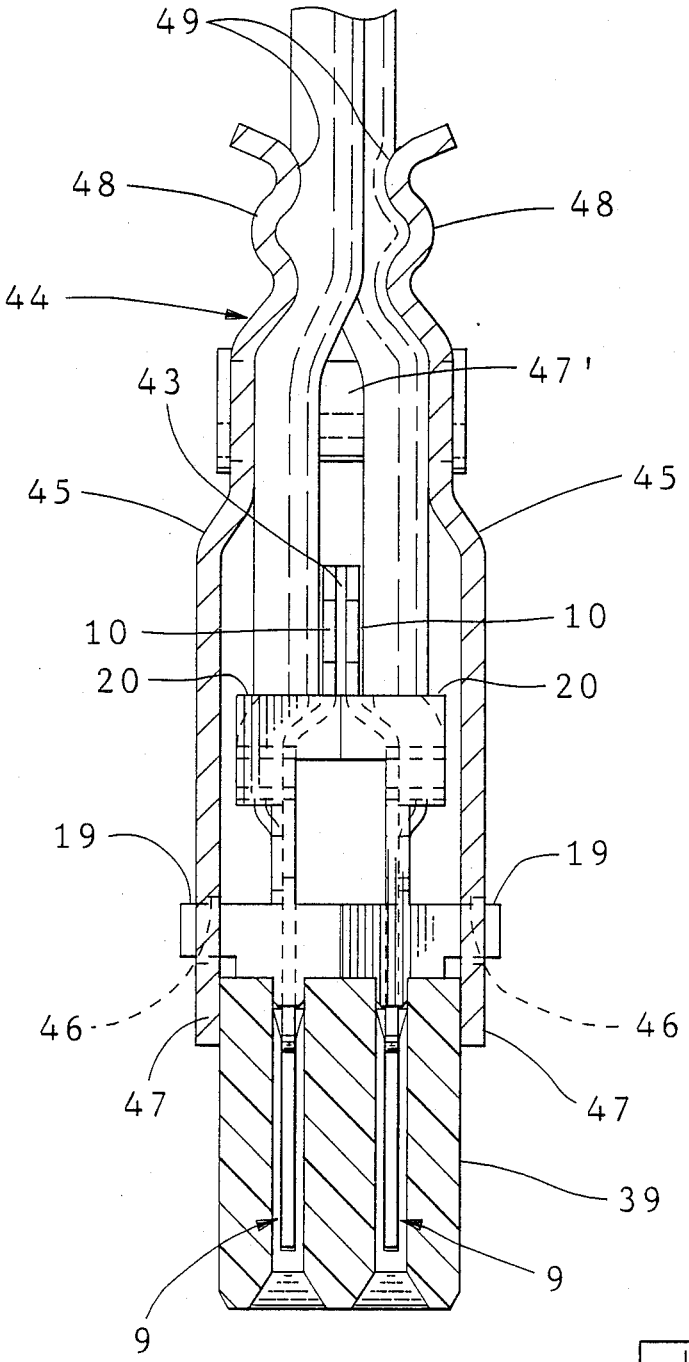
FIG. 8 is an enlarged elevation view in section of the composite connector assembly shown in FIG. 1.

With reference to FIGS. 1 and 8, a strain relief 44 for the cables 1 is formed from a pair of identical plates 45,45. Each plate 45 includes an opening 46 in which registers a laterally projecting rear wall 20 of a corresponding housing block 16. Fasteners, for example, rivets 47, secure the plates 45 together. The housing 39 is clamped between front ends 47,47 of the corresponding plates 45,45 that overlap corresponding sides of the housing 39. The cables 1 are clamped between rear ends 48,48 of the corresponding plates 45,45 that have corresponding curved surfaces 49,49 compressed against the cables 1.

Figure 9:
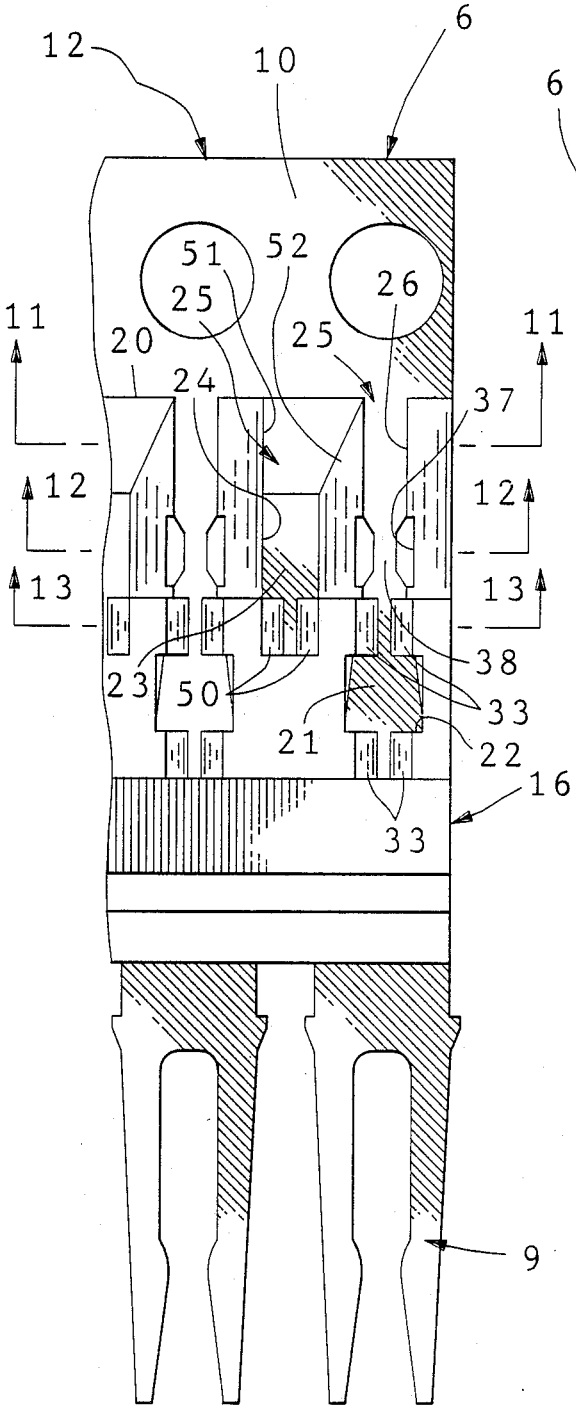
FIG. 9 is a plan view of another connector assembly including another housing block and the lead frame shown in FIG. 2.
Figure 10:
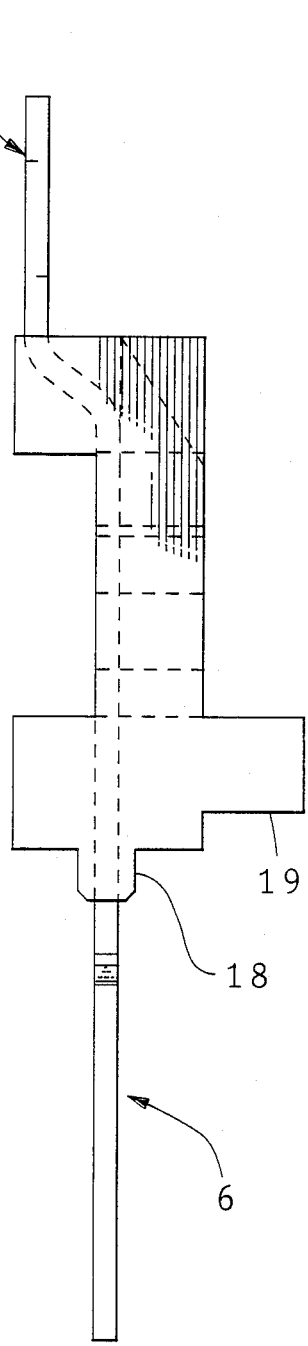
FIG. 10 is an elevation view of the connector assembly shown in FIG. 9.
Figure 11:
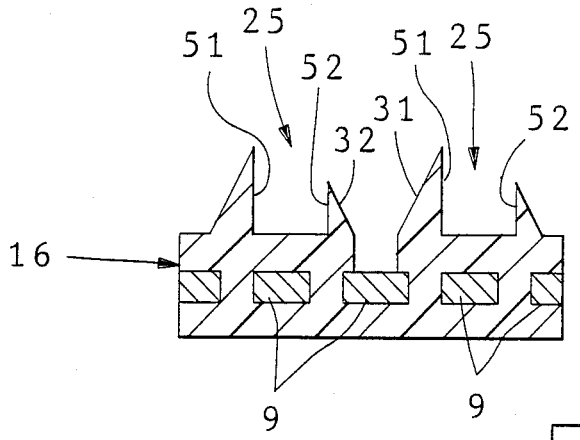
FIG. 11 is a section view taken along the line 11—11 of FIG. 9.
Figure 12:
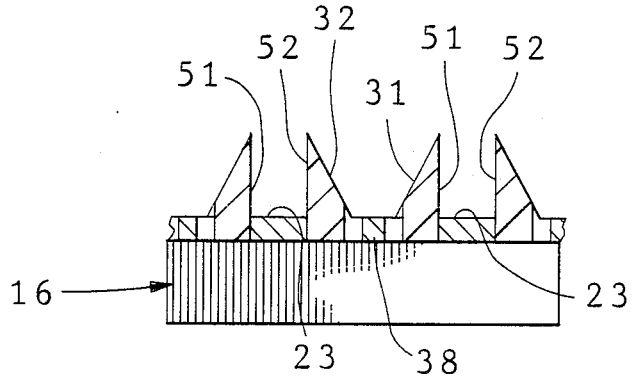
FIG. 12 is a section view taken along the line 12—12 of FIG. 9.
Figure 13:
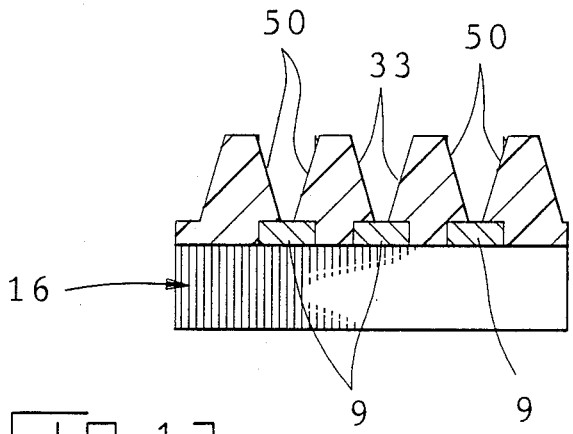
FIG. 13 is a section view taken along the line 13—13 of FIG. 9.

With reference to FIGS. 9 and 10, another form of the connector assembly 6 includes the lead frame 12 and the housing block 16 with differences in construction described as follows. Each first channel portion 26 of a wire receiving channel 25 communicates with a corresponding first opening 22 at which appears a wire connecting portion 21 of a corresponding signal contact 9 of the lead frame 12. Each second channel portion 27 of a wire receiving channel 25 communicates with the rear wall 20 of the housing block 16 and communicates with a corresponding second opening 24 at which appears a corresponding wire connecting portion 23 of the ground bus 10.

Figure 14:
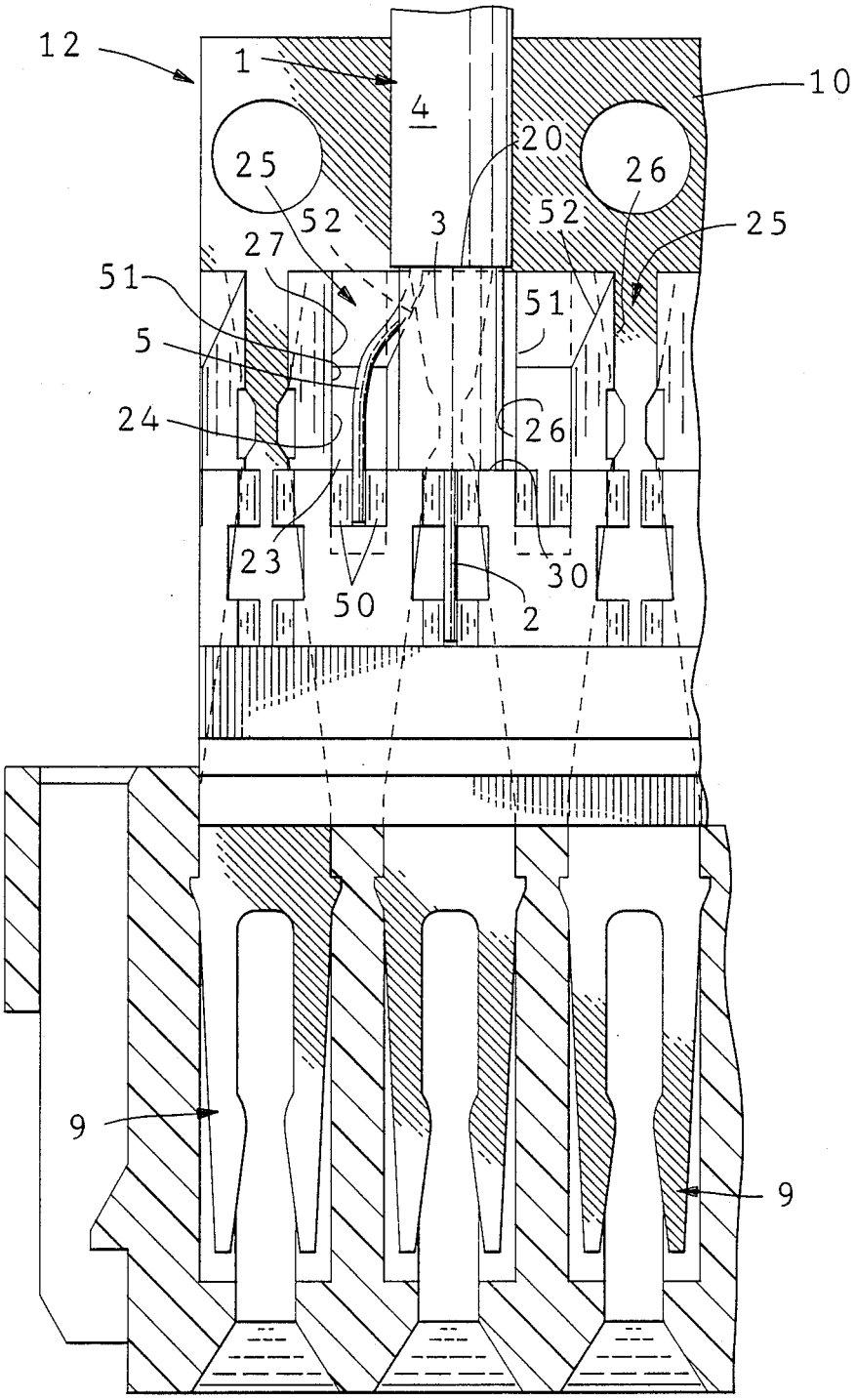
FIG. 14 is a plan view of the connector assembly shown in FIG. 9 together with an electrical cable.

With reference to FIGS. 9 and 14, each channel 25 receives a portion of a corresponding cable 1 such that an end of the jacket 4 engages against the rear wall 20, the signal wire 2 extends along the first channel portion 26 and along the wire connecting portion 21 of a corresponding signal contact 9, and the ground wire 5 extends along the second channel portion 27 and along the wire connecting portion 23 of a corresponding ground bus 10.

Figure 15:
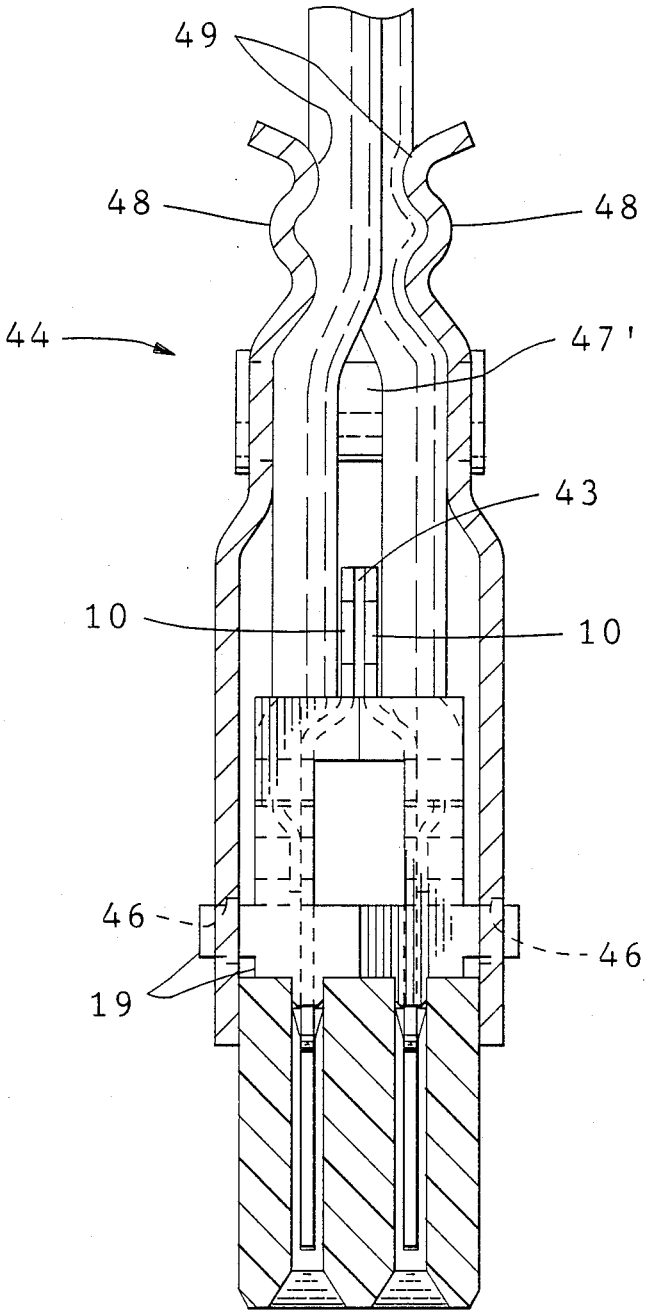
FIG. 15 is an elevation view in section of a composite electrical connector assembly.

Each second channel portion 27 includes converging tapered sides 50,50 defining wire gripping portions adjacent to a corresponding second opening 24 for gripping a corresponding ground wire 5 and for positioning the ground wire 5 along a corresponding wire connecting portion 23 of the ground bus 10 during formation of a wire connection. Each second channel portion 27 includes a surface 51 facing toward the opposite surface 52 that is outwardly flared toward a corresponding first channel portion 26. The surfaces 51 and 52 engage and guide a corresponding ground wire 5 that is bent to project diagonally against the surface 52 and along the second channel portion 27. With reference to FIG. 15, each plate 44 includes the opening 46 in which registers a portion of a laterally projecting wall 19 of a corresponding housing block 16.

The frond end 19 of the housing block 16, in each of FIGS. 6, 7, 8, 14 and 15, enter into a groove 19, of housing 39 to provide a tongue 19, and groove 19 interface which can be sealed by ultrasonic welding to seal the rear of the housing 39 from entry of contaminants.

We claim:

1. An electrical connector for connection to ground wires and signal wires of at least one corresponding cable comprising; conductive signal contacts having wire connecting portions for connection to corresponding signal wires, and wire connecting portions of a corresponding ground bus for connection to corresponding ground wires, wherein the improvement comprises;

a unitary lead frame joins the ground bus and the signal contacts prior to selected ones of the signal contacts being detached from the ground bus, an insulative housing block assembled over the lead frame prior to selected ones of the signal contacts being detached from the ground bus, the wire connecting portions appear at first openings in the housing block, and means on the lead frame appear at additional openings in the housing block for detaching the signal contacts individually from the ground bus, whereby the selected ones of the signal contacts contacts are constructed for being detached from the ground bus and at least one signal contact is constructed to remain joined to the ground bus.

2. An electrical connector as recited in claim 1, wherein the improvement comprises;

each of the first openings extends through opposite sides of the first recited housing block to receive a removable, opposed pair of welding electrodes for clamping therebetween a corresponding wire and a corresponding wire connecting portion.

3. An electrical connector as recited in claim 1, wherein the improvement comprises;

each of said additional openings extends from one side of the housing block to an opposite side of the housing block.

4. An electrical connector as recited in claim 1, wherein the improvement comprises;

each first opening is encircled by the housing block for isolation one from another said first opening, and the housing block is a solder stop off encircling each first opening.

5. An electrical connector as recited in claim 1, wherein the improvement comprises;

the corresponding additional openings in the housing block are between wire connecting portions of the ground bus and a corresponding signal contact, and provide solder stop offs.

6. An electrical connector as recited in claim 1, wherein the improvement comprises;

wire receiving channels of the housing block extend into corresponding first openings, wire gripping portions of the housing block for gripping corresponding wires extending from the wire receiving channels and across the corresponding first openings, the corresponding first openings being between the wire receiving channels and the wire gripping portions.

7. An electrical connector as recited in claim 1 wherein the improvement comprises;

wire receiving channels in the first recited housing block, each wire receiving channel dividing into a first channel portion communicating with a corresponding first opening and a second channel portion communicating with a corresponding first opening, and the first channel portion separates a corresponding signal wire extending along the first channel portion from a corresponding ground wire extending along the second channel portion.

8. An electrical connector as recited in claims 1, 2, 3, 4, 5, 6 or 7, wherein the improvement comprises;

the lead frame is recessed below external surfaces of the housing block, and the ground wires and the signal wires are joined within the thickness of the housing block to, corresponding wire connecting portions.

9. An electrical connector as recited in claims 1, 2, 3, 4, 5, 6 or 7, wherein the improvement comprises;

the ground bus projects from the housing block, and a conductive ground bar is joined to the ground bus.

10. An electrical connector as recited in claims 1, 2, 3, 4, 5, 6 or 7, wherein the improvement comprises;

at least a portion of the ground bus projects from the housing block, and an insulative bar separate from the housing block is joined to the portion of the ground bus.

11. An electrical connector as recited in claims 1, 2, 3, 4, 5, 6, or 7, wherein the improvement comprises;

the wire connecting portions of the signal contacts are in a first row facing a side of the housing block, and the wire connecting portions of the ground bus are in a second row facing the same side of the housing block.

12. An electrical connector as recited in claims 1, 2, 3, 4, 5, 6 or 7, wherein the improvement comprises;

said means comprise portions of the signal contacts constructed for being severed.

13. An electrical connector as recited in claims 1, 2, 3, 4, 5, 6 or 7, wherein the improvement comprises;

each signal contact remaining joined to the ground bus has a portion constructed for being severed, said portion extending across a corresponding additional opening in the housing block.

14. An electrical connector assembly for connection to ground wires and signal wires comprising; conductive signal contacts having wire connecting portions for connection to corresponding signal wires, and wire connecting portions of a corresponding ground bus for connection to corresponding ground wires, wherein the improvement comprises;

an insulative first housing block carrying a first ground bus and a first group of the signal contacts, selected ones of the signal contacts of the first group detached from the ground bus and at least one signal contact of the first group joined to the ground bus, an insulative second housing block carrying a second ground bus and a second group of the signal contacts, and the first ground bus and the second ground bus being joined together.

15. An electrical connector assembly as recited in claim 14 wherein the improvement comprises;

the first ground bus and the second ground bus project outwardly of the corresponding housing blocks.

16. In an electrical connector assembly as recited in claim 14 the improvement comprising;

a conductive ground bar joined to the first ground bus and the second ground bus.

17. An electrical connector assembly as recited in claim 14 wherein the improvement comprises;

insulative means separate from the housing blocks and for being joined to and insulatively separating the first ground bus and the second ground bus externally of the housing blocks.

18. In an electrical connector assembly as recited in claims 1, 2, 3, 4, 5, 6, 7, 14, 15, or 16, the improvement comprising;

each signal wire and a corresponding ground wire are within a sheath, and each signal wire is encircled by dielectric means.

* * * * *